US008800317B2

(12) United States Patent
Dallas et al.

(10) Patent No.: US 8,800,317 B2
(45) Date of Patent: Aug. 12, 2014

(54) GEOMETRICALLY OPTIMIZED BEVERAGE COOLER

(76) Inventors: Milton Dallas, East Troy, WI (US); Russell Robers, Waterford, WI (US)

( * ) Notice: Subject to any disclaimer, the term of this patent is extended or adjusted under 35 U.S.C. 154(b) by 1116 days.

(21) Appl. No.: 12/761,320

(22) Filed: Apr. 15, 2010

(65) Prior Publication Data

US 2011/0252824 A1 Oct. 20, 2011

(51) Int. Cl.

| | |
|---|---|
| ***F25D 3/08*** | (2006.01) |
| ***B65D 21/00*** | (2006.01) |
| ***B65D 85/62*** | (2006.01) |
| ***B65D 75/00*** | (2006.01) |
| ***B65D 65/00*** | (2006.01) |
| ***B65D 43/02*** | (2006.01) |
| ***B65D 1/26*** | (2006.01) |
| ***B65D 1/40*** | (2006.01) |
| ***B65D 25/28*** | (2006.01) |

(52) U.S. Cl.

CPC ..... *B65D 1/26* (2013.01); *B65D 43/022* (2013.01); *F25D 2331/805* (2013.01); *F25D 2331/803* (2013.01); *B65D 1/40* (2013.01); *B65D 2543/00351* (2013.01); *F25D 3/08* (2013.01); *B65D 2543/00296* (2013.01); *B65D 25/2888* (2013.01); *F25D 2500/02* (2013.01); *F25D 2303/081* (2013.01); *B65D 25/2891* (2013.01); *B65D 2543/00074* (2013.01)

USPC ..... 62/457.8; 206/162; 206/427; 206/518

(58) Field of Classification Search

USPC ..... 206/518, 162, 427; 62/457.8

See application file for complete search history.

(56) References Cited

U.S. PATENT DOCUMENTS

| | | | | |
|---|---|---|---|---|
| 2,839,209 | A | 6/1958 | Lester et al. | |
| 5,086,917 | A | 2/1992 | Dziersk et al. | |
| 5,199,571 | A | 4/1993 | Wolff et al. | |
| 5,267,685 | A | 12/1993 | Sorensen | |
| 5,495,727 | A * | 3/1996 | Strong et al. | 62/529 |
| 5,547,098 | A * | 8/1996 | Jordan | 220/23.86 |
| 5,609,318 | A | 3/1997 | Scheh | |
| 5,669,498 | A * | 9/1997 | Fierek et al. | 206/373 |
| 6,398,062 | B1 * | 6/2002 | Jones | 220/608 |
| 6,631,803 | B2 | 10/2003 | Rhodes et al. | |
| 7,290,651 | B2 * | 11/2007 | Irwin et al. | 206/216 |
| D560,977 | S | 2/2008 | Lown et al. | |
| D608,155 | S | 1/2010 | Jeffries | |
| 2005/0173431 | A1 | 8/2005 | Robertson et al. | |
| 2007/0033964 | A1 | 2/2007 | Huang | |
| 2007/0074795 | A1 | 4/2007 | Moore | |
| 2007/0209384 | A1 | 9/2007 | Stewart et al. | |
| 2009/0026100 | A1 * | 1/2009 | Erba | 206/427 |

OTHER PUBLICATIONS

Web page by Unica home, dated Jul. 6, 2009 for Italesse Ice Bucket at http://web.archive.org/web/20090706233618/http:/www.unicahome.com/p50648/italesse/grand-pagoda-champagne-bucket-by-italesse.html.*

* cited by examiner

*Primary Examiner* — Allen Flanigan
*Assistant Examiner* — Filip Zec
(74) *Attorney, Agent, or Firm* — Absolute Technology Law Group LLC

(57) ABSTRACT

The present invention is a geometrically optimized beverage cooler, which positions fluid-filled containers (bottles, cans, vials, syringes, etc.) in an angled, upright, and evenly spaced position for serving and display. The device uniformly distributes ice and cold water around each bottle to maximize the effective cooling capacity of a given quantity of ice, thus reducing the amount of ice needed and the weight of the device during transport. Various embodiments of the apparatus include an ergonomically and structurally reinforced handle and an insulating lid having complementary contours.

24 Claims, 12 Drawing Sheets

GEOMETRICALLY OPTIMIZED BEVERAGE COOLER

FIELD OF INVENTION

The present invention relates to the field of beverage bottles and fluid receptacles, and more specifically to a beverage cooler which has improved cooling efficiency and functionality over standard bottle storage and cooling devices.

GLOSSARY

Figure 1A:
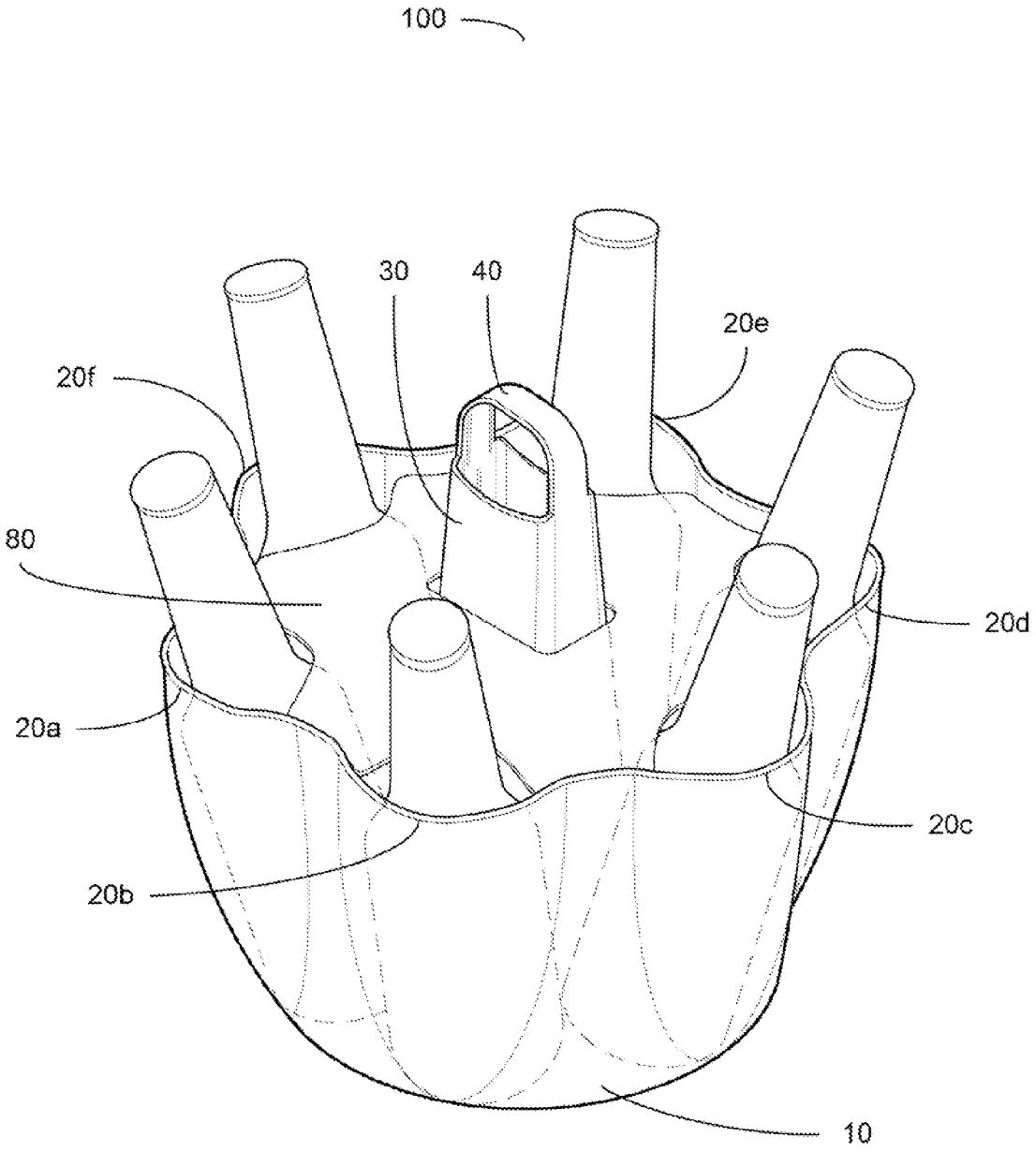
FIG. 1*a* illustrates a side perspective view of one embodiment of a geometrically optimized beverage cooler with uniform size support contours for similar sized beverages.

As used herein, the term "cooler" refers to any apparatus, container or receptacle for holding ice and cooling materials.

As used herein, the term "beverage container" refers to any fluid-filled container such as a bottle, can, carafe, vial or syringe, and is not limited to containers in which the beverage is a fluid.

As used herein, the term "angled surface" or "angled bottom surface" means angled relative to at least one horizontal and at least one perpendicular surface. An angled surface may include, but is not limited to a dome shape or a solid curved structure and may be comprised of one or more segments or angled structures.

As used herein, the term "perimeter ridge" refers to a raised edge of an object.

As used herein, the term "flattened perimeter area" refers to a level portion of a component which rests on a surface (e.g., table).

As used herein, the term "integrally constructed" means formed or created as a single piece or complete unit.

As used herein, the term "friction resistant structures" refers to a structural component including, but not limited to grooves, protuberances, contour, or deformations that reduces the resistance of one component against another.

As used herein, the term "fluted" means having at least one groove or furrow.

BACKGROUND

Consumers spend billions of dollars on bottled and canned beverages each year. The market for beer alone is in excess of $100 billion dollars, and more than 40 billion dollars of bottled water is sold year. Bottles may be made of glass, plastic or other materials. Cans are made of a variety of recyclable metals.

Most beverages are consumed in social settings, such as parties, bars, restaurants, and other events.

Beverage coolers (including chests, buckets, pails and other storage devices) are generally used by consumers to store and serve bottled beverages in settings where ice, rather than standard refrigeration, must be used to cool bottled and canned beverages. Chests are desirable because they hold a quantity of beverages and may be insulated or constructed to serve as portable refrigerators. Buckets (e.g., champagne buckets) may be ornamental or easy to transport. They are generally constructed with handles and prevent leaking of melting ice.

Coolers made of Styrofoam™ or other inexpensive materials are frequently sold at the point-of-purchase for these beverages. Additionally, beer and wine cooling devices are sold at retail outlets and command considerable shelf space in seasonal and non-seasonal markets. Coolers are profitable items for which competition is intense. For example, Walmart™ alone carries several dozen coolers in its stores simultaneously.

The cost of coolers and beer buckets can range from a few dollars to more than $80.00 to $100.00. Generally, Styrofoam™ containers dominate the low cost market and are sold at point-of-purchase. In addition, they are lightweight and stackable.

However, Styrofoam™ is environmentally hazardous, flakes easily and is unattractive to display. Styrofoam® is also not a material which is attractive for consumers to re-use and Styrofoam™ coolers are discarded at a high rate because of these issues, resulting in a short useful life.

Cooler and bucket devices known in the art also take up storage space, making it impractical to keep a number of devices on hand for occasional use (e.g., for parties, picnics or barbeques). Collapsible coolers directed at this problem are known in the art, but are cumbersome and often prone to mildew because they have numerous crevices.

In addition, the rectangular and/or rounded design of traditional coolers and buckets is not adapted for retail sale environments or for consumers who have not previously intended to purchase a cooler. Traditional chest-type coolers and buckets lack the visual appeal necessary for consumers to consider them as a point-of-purchase item (e.g., displayed near a register with limited counter space).

Additionally, the market is relatively untapped for consumers who want small receptacles for cooling and transporting beverages in the most popularly sold quantities: 6 packs, 12 packs, 24 packs and 30 packs.

Users of traditional coolers and buckets also need to manually push aside wet ice cubes to find a bottle. When multiple types of beverages are stored in a cooler, a user must lift the bottles out of the cooler in order to read the label.

It is desirable to have a device which makes beverages visible for selection based on a user's preference and easy for a user to grasp without the need for the user to grope through ice and cold water.

Little attention has been given to optimizing the geometric configuration of coolers and buckets so that less ice may be used, cooling efficiency may be optimized, and the weight of transporting the apparatus may be reduced.

Traditional coolers and buckets are not adapted for display and use on tables, buffets, and at other events, and their design does not encourage consumers to re-use them. Coolers and buckets look out of place on serving tables, rather than blend into the serving décor.

SUMMARY OF THE INVENTION

The present invention is a geometrically optimized beverage cooler, which positions fluid-filled containers (bottles, cans, vials, syringes, etc.) in an angled, upright, and evenly spaced position for serving and display. The device uniformly distributes ice and cold water around each bottle to maximize the effective cooling capacity of a given quantity of ice, thus reducing the amount of ice needed and the weight of the device during transport. Various embodiments of the apparatus include an ergonomically and structurally reinforced handle and an insulating lid having complementary contours.

DETAILED DESCRIPTION OF INVENTION

For the purpose of promoting an understanding of the present invention, references are made in the text to exemplary embodiments of a geometrically optimized beverage cooler, only some of which are described herein. It should be understood that no limitations on the scope of the invention are intended by describing these exemplary embodiments. One of ordinary skill in the art will readily appreciate that alternate but functionally equivalent materials, sizes, shapes and designs may be used. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention.

It should be understood that the drawings are not necessarily to scale; instead, emphasis has been placed upon illustrating the principles of the invention. In addition, in the embodiments depicted herein, like reference numerals in the various drawings refer to identical or near identical structural elements.

Moreover, the terms "substantially" or "approximately" as used herein may be applied to modify any quantitative representation that could permissibly vary without resulting in a change in the basic function to which it is related.

FIG. 1*a* illustrates a side perspective view of one embodiment of a highly efficient geometrically optimized cooler 100 having cooler body 10 and uniform size support contours 20*a*, 20*b*, 20*c*, 20*d*, 20*e* and 20*f* which are evenly spaced to partially encase and support uniform size bottle structures at an angle of 90 to 150 degrees. The slope of angled bottom 50 (not shown) directs the angle at which the bottles are positioned when placed in geometrically optimized cooler 100.

In other embodiments, support contours 20*a*, 20*b*, 20*c*, 20*d*, 20*e* and 20*f* may be adapted to encase fewer other types of fluid-filled containers such as cans, vials, carafes, glasses and syringes. Geometrically optimized cooler 100 may include more or fewer support contours 20*a*, 20*b*, 20*c*, 20*d*, 20*e* and 20*f*, and in other embodiments, support contours 20*a*, 20*b*, 20*c*, 20*d*, 20*e* and 20*f* may not be uniform to accommodate various sizes of fluid-filled containers. In still other embodiments, support contours 20*a*, 20*b*, 20*c*, 20*d*, 20*e* and 20*f* may not be symmetrical or evenly spaced.

Also visible in FIG. 1 is center column 30 which includes handle 40. In various embodiments, center column 30 may be hollow, solid, cylindrical, angled, tapered, or have any other shape, size or proportions. In the embodiment shown, center column 30 is tapered and hollow allowing for stacking.

In the embodiment shown, geometrically optimized cooler 100, center column 30, and handle 40 are a singly molded component formed from an injection molding process. In other embodiments, geometrically optimized cooler 100 may be constructed of multiple components (e.g., a separately formed handle or insulating layer). In various embodiments, handle 40 may be rigid, semi-rigid or flexible.

In the embodiment shown, geometrically optimized cooler 100 is comprised of polyethylene plastic, but in other embodiments may be comprised of another type of plastic or materials having the following qualities: resistance to ultraviolet rays, ability to function under temperature variations, fluid impermeable, light weight and low cost. In various embodiments, geometrically optimized cooler 100 may be of any size or proportions.

Figure 1B:
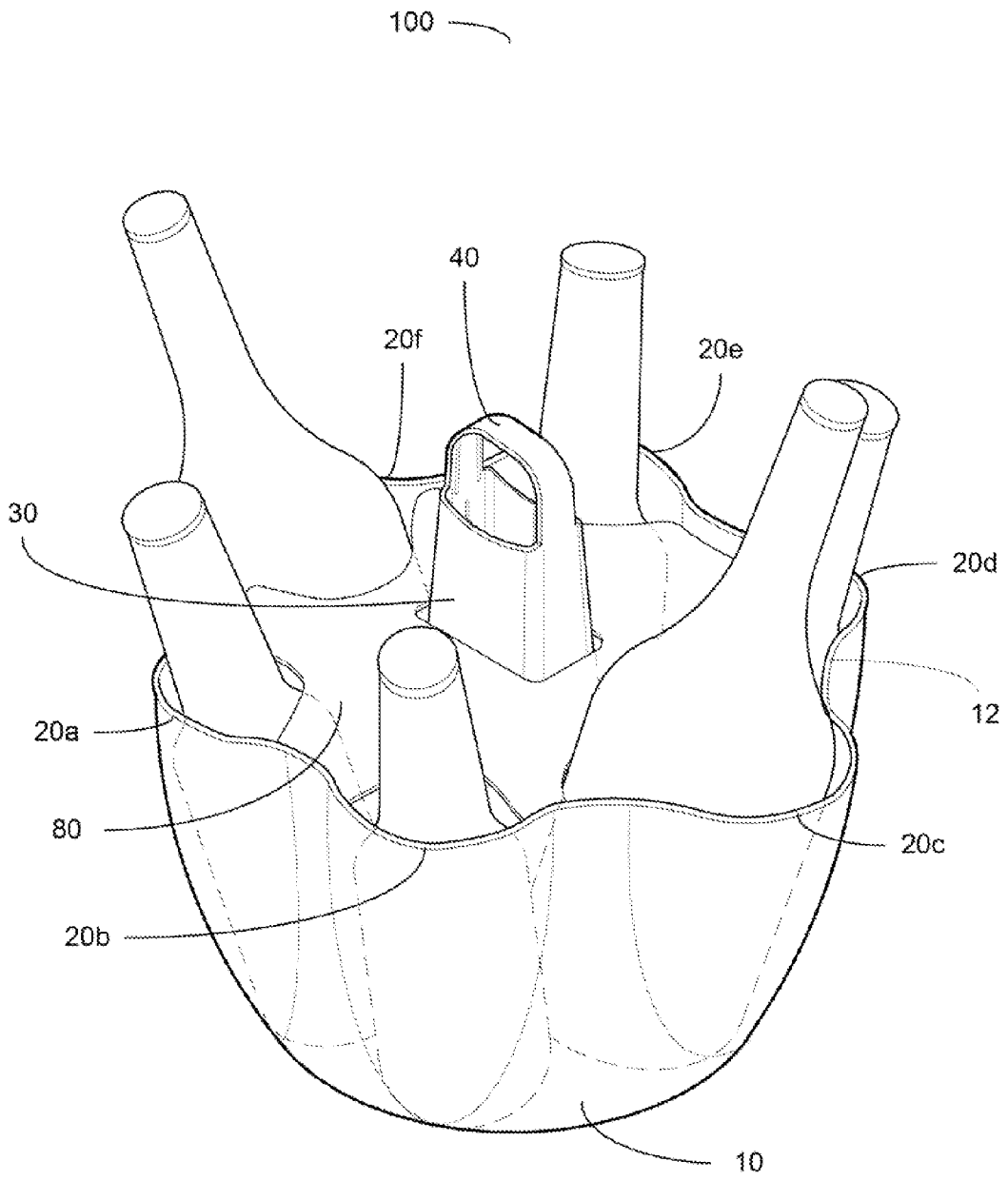
FIG. 1*b* illustrates a side perspective view of one embodiment of a geometrically optimized beverage cooler with non-uniform size support contours for beverages of varying sizes.

FIG. 1*b* illustrates a side perspective view of one embodiment of geometrically optimized beverage cooler 100 with support contours 20*a*, 20*b*, 20*c*, 20*d*, 20*e* and 20*f* of non-uniform sizes to accommodate beverage containers of varying sizes. In the embodiment shown, cooler body 10 further includes structural supporting perimeter ridge 12, which prevents cooler from being deformed and provides structural support/integrity for cooler body 10 and support contours 20*a*, 20*b*, 20*c*, 20*d*, 20*e* and 20*f* by strengthening and adding rigidity.

Figure 1C:
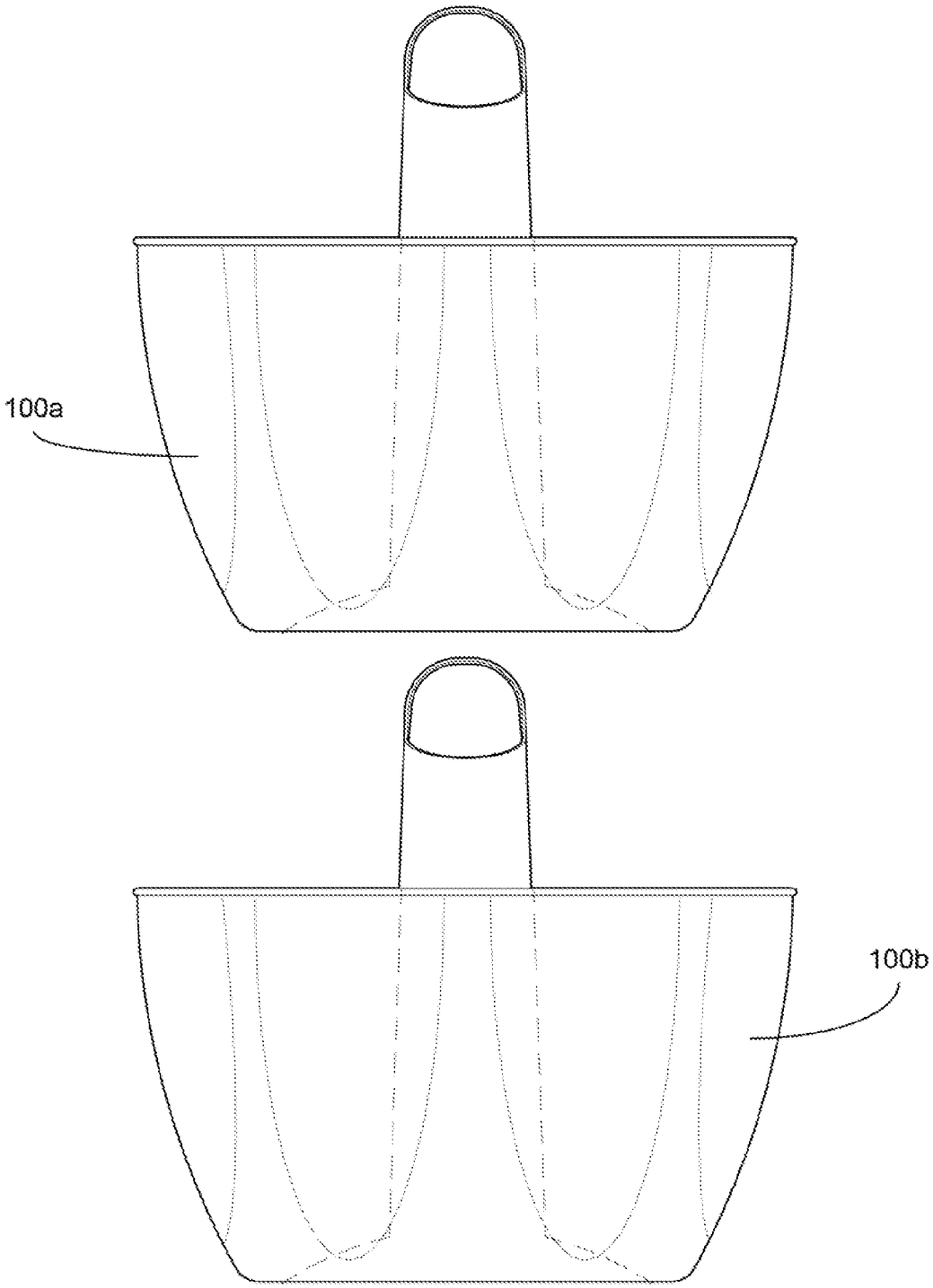
FIG. 1*c* illustrates an exploded view of two geometrically optimized beverage coolers stacked.

FIG. 1*c* illustrates an exploded view of two geometrically optimized coolers 100*a* and 100*b* illustrating their capability of being stacked.

Figure 1D:
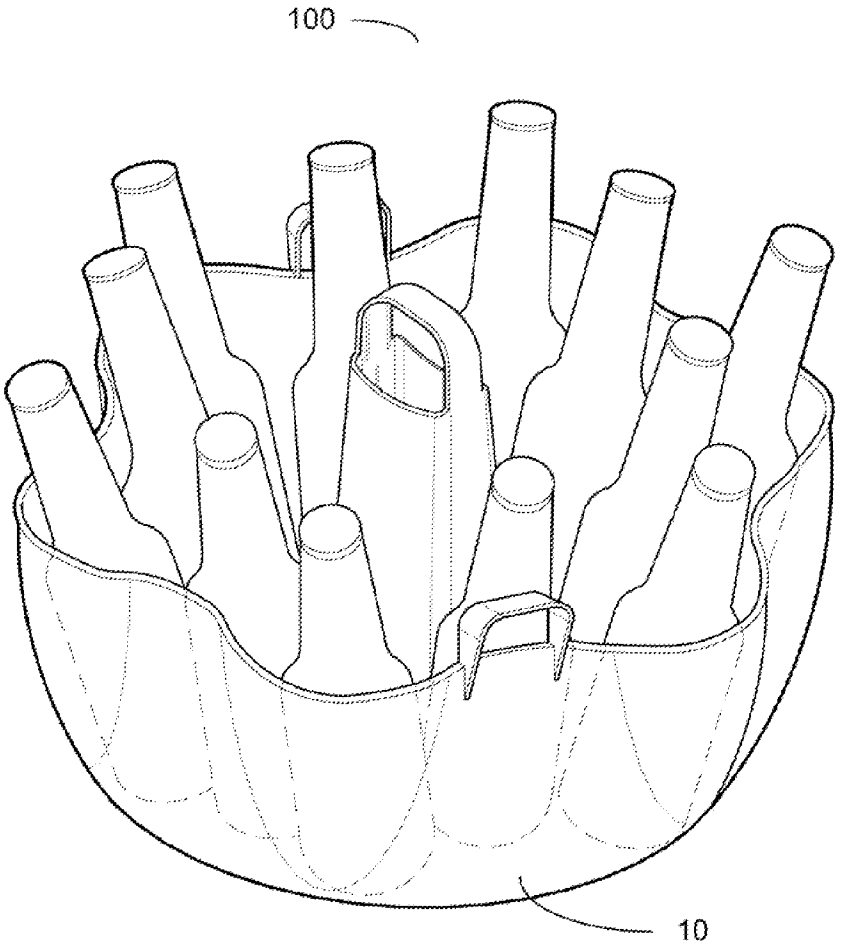
FIG. 1*d* illustrates a side perspective view of a second embodiment of a geometrically optimized beverage cooler.

FIG. 1*d* illustrates a side perspective view of a second embodiment of geometrically optimized cooler 100 which has a larger area for holding fluid-filled containers and includes additional handles for carrying geometrically optimized cooler 100.

Figure 2A:
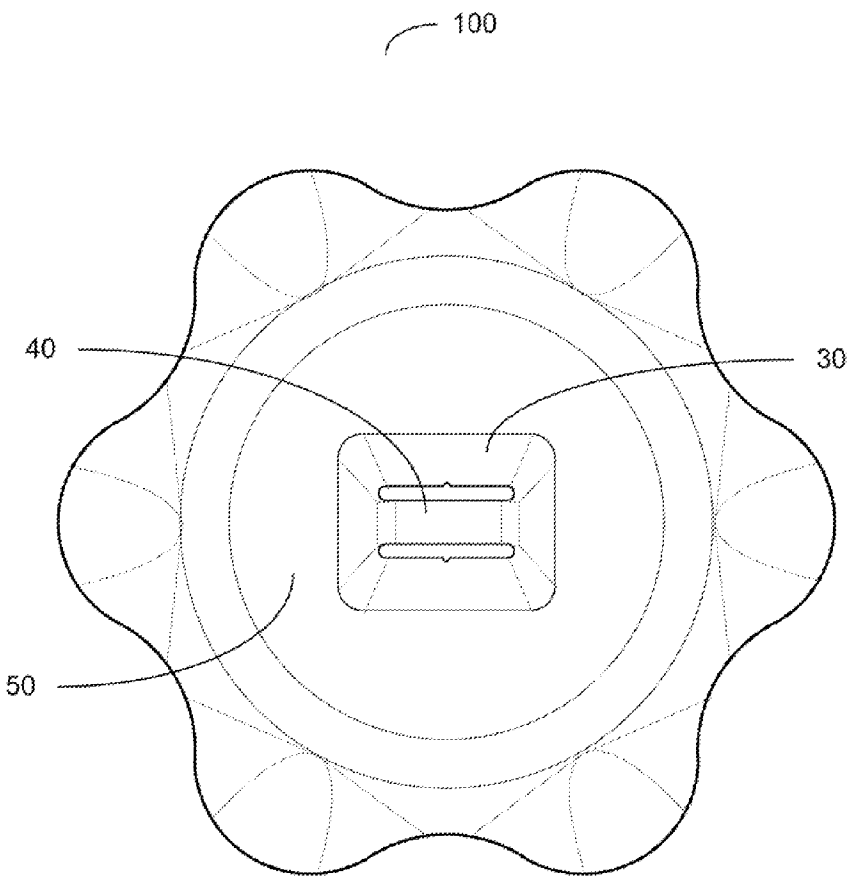
FIG. 2*a* illustrates a top view of one embodiment of a geometrically optimized beverage cooler.

FIG. 2*a* illustrates a top view of highly efficient geometrically optimized cooler 100 illustrating angled bottom 50, which is a contoured bottom surface which supports bottles or other containers placed in geometrically optimized cooler 100. Angled bottom 50 forces bottles, cans or other fluid-filled containers to tilt outward against the inner surface of cooler body 10 and within support contours 20*a*, 20*b*, 20*c*, 20*d*, 20*e* and 20*f*.

Also visible in FIG. 2*a* is handle 40, which in the embodiment shown, is a flattened handle with a structural ridge along the perimeter for structural reinforcement and strength. In other embodiments, handle 40 may be curved, contoured to receive one or more fingers, or otherwise altered or enhanced without departing from the functionality of a handle. In still other embodiments, handle 40 may be constructed from different or additional components than that of cooler body 10.

Figure 2B:
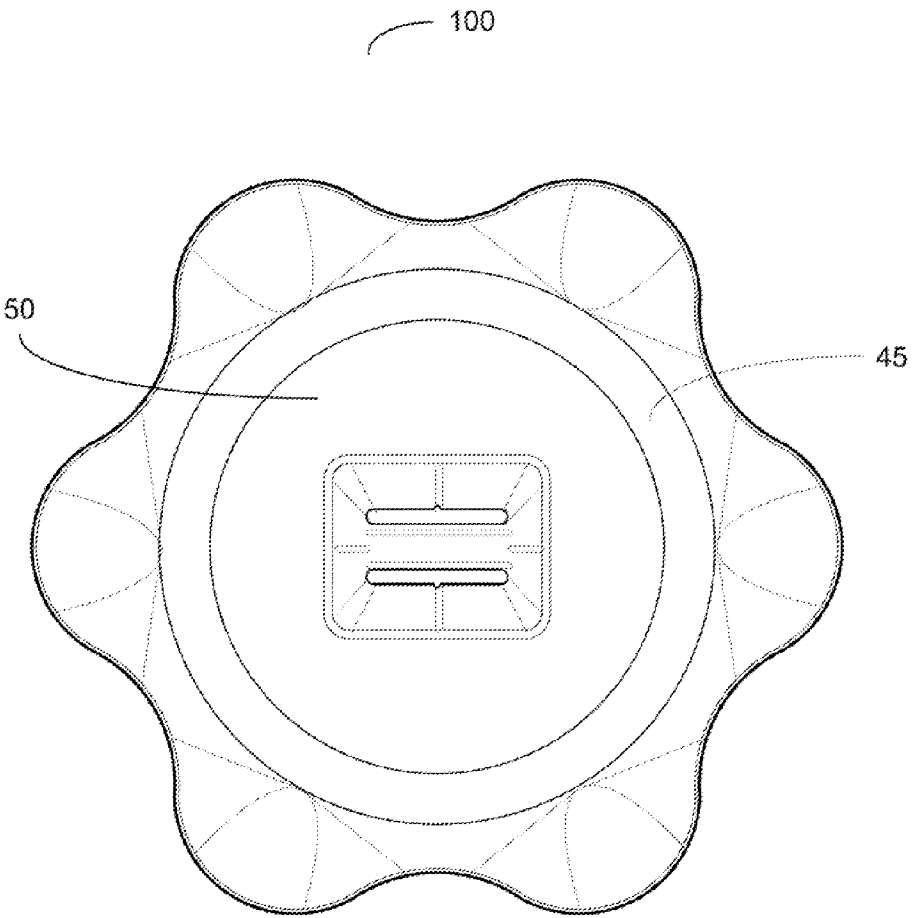
FIG. 2*b* illustrates a bottom view of one embodiment of a geometrically optimized beverage cooler.

FIG. 2*b* illustrates a bottom view of highly efficient geometrically optimized cooler 100, further illustrating angled bottom 50. In the embodiment shown, geometrically optimized cooler 100 has flattened perimeter area 45 which ensures that geometrically optimized cooler 100 remains level. In other embodiments, flattened perimeter area 45 may have a larger number of contact points (e.g., may have three separate contact points).

Figure 3A:
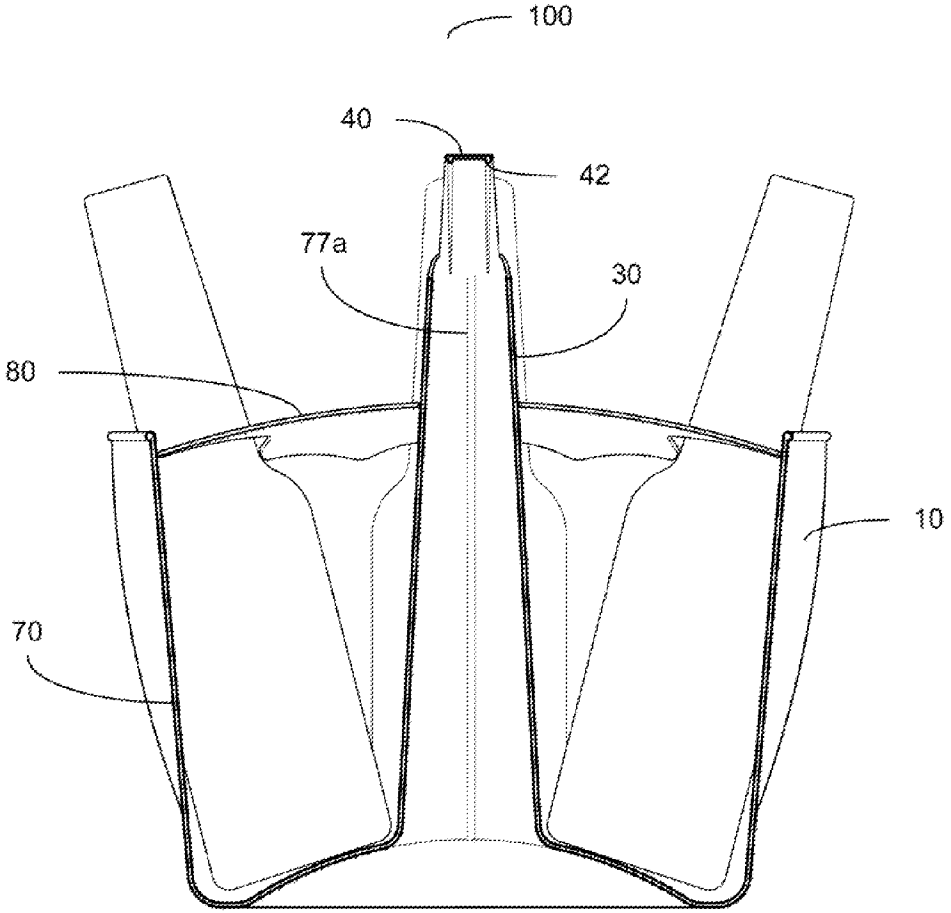
FIG. 3*a* illustrates a sectional view of one embodiment of a geometrically optimized beverage cooler.

FIG. 3*a* illustrates a sectional view of highly efficient geometrically optimized cooler 100. Visible in FIG. 3*a* are cooler body 10, center column 30, lid 80, and handle 40. In various embodiments, center column 30 may be tapered, hollow, or solid. Also visible in FIG. 3*a* is structural and reinforcing handle rib 42.

In the embodiment shown, cooler body 10 of geometrically optimized cooler 100 is comprised of a single layer 70; however, in other embodiments may be comprised of additional layers such as decorative material, insulating material or strengthening material. Cooler body 10 may have additional ribs, supports or structural contours, and may include apertures for inserting handles or for drainage.

FIG. 3*a* also illustrates friction resistant structures 77*a* and 77*b* (77*b* not visible), which are on the inner surface of center column 30 and prevent center columns 30 from adhering together when stacked. In various embodiments, friction resistant structures 77*a* and 77*b* may be grooves or protuberances or any other friction resisting contours or deformations.

Figure 3B:
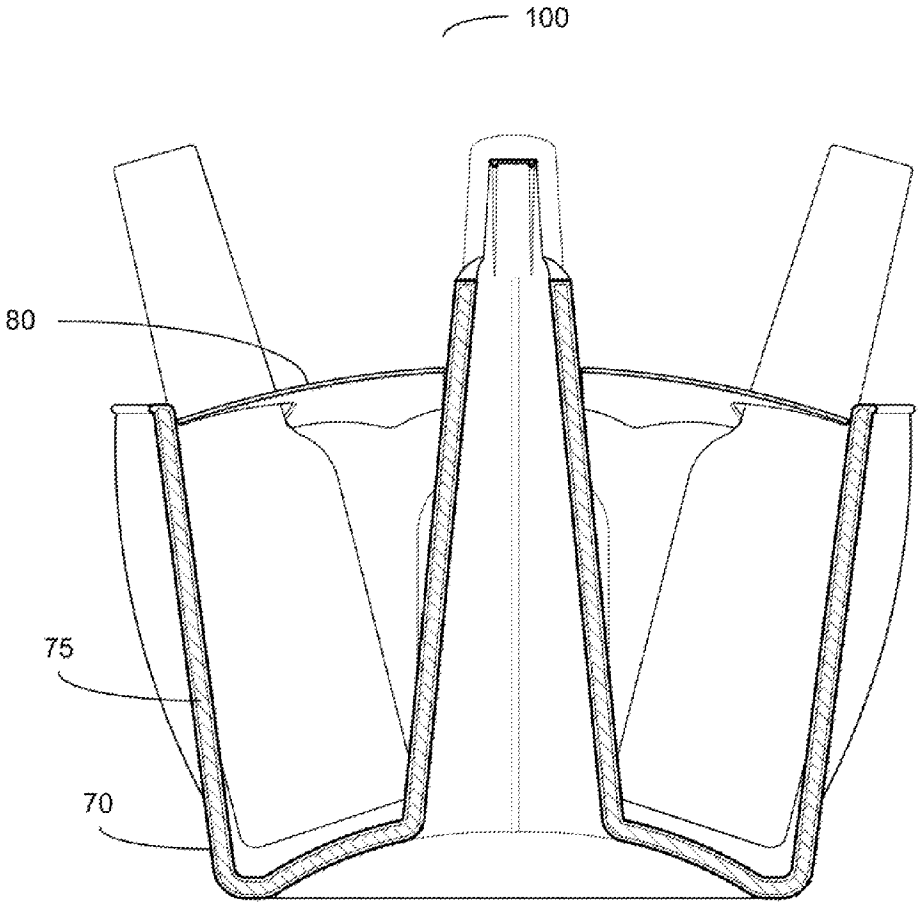
FIG. 3*b* illustrates a sectional view of an alternate embodiment of a geometrically optimized beverage cooler.

FIG. 3*b* illustrates a sectional view of an alternate embodiment of geometrically optimized cooler 100, which includes optional insulating layer 75 which may be foam, rubber or any other insulating material or coating known in the art. Other embodiments may include optional outer layers (not shown), including ornamentation such as paint, decals, fabric, or any other material capable of being formed into an outer layer.

Figure 4A:
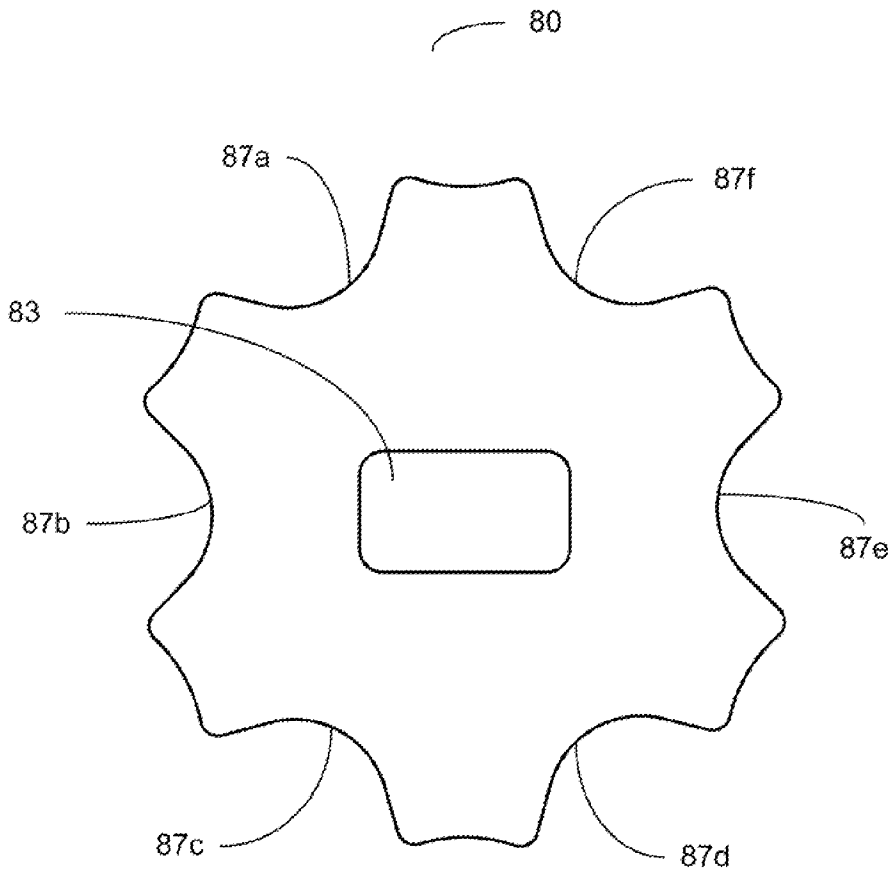
FIG. 4*a* illustrates a top view of one embodiment of a lid for a geometrically optimized beverage cooler.

FIG. 4*a* illustrates a top view of one embodiment of lid 80 for geometrically optimized cooler 100. In the embodiment shown, lid 80 has lid contours 87*a*, 87*b*, 87*c*, 87*d*, 87*e* and 87*f* and lid aperture 83 adapted to receive center column 30.

Figure 4B:
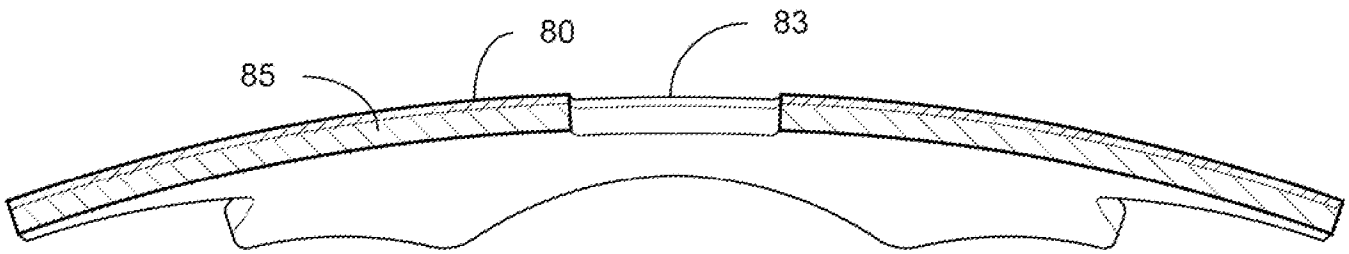
FIG. 4*b* illustrates a sectional view of one embodiment of a lid for a geometrically optimized beverage cooler.

FIG. 4*b* illustrates a sectional view of an alternate embodiment of lid 80 for geometrically optimized cooler 100. In the embodiment shown, lid 80 further includes insulating layer 85.

Figure 4C:
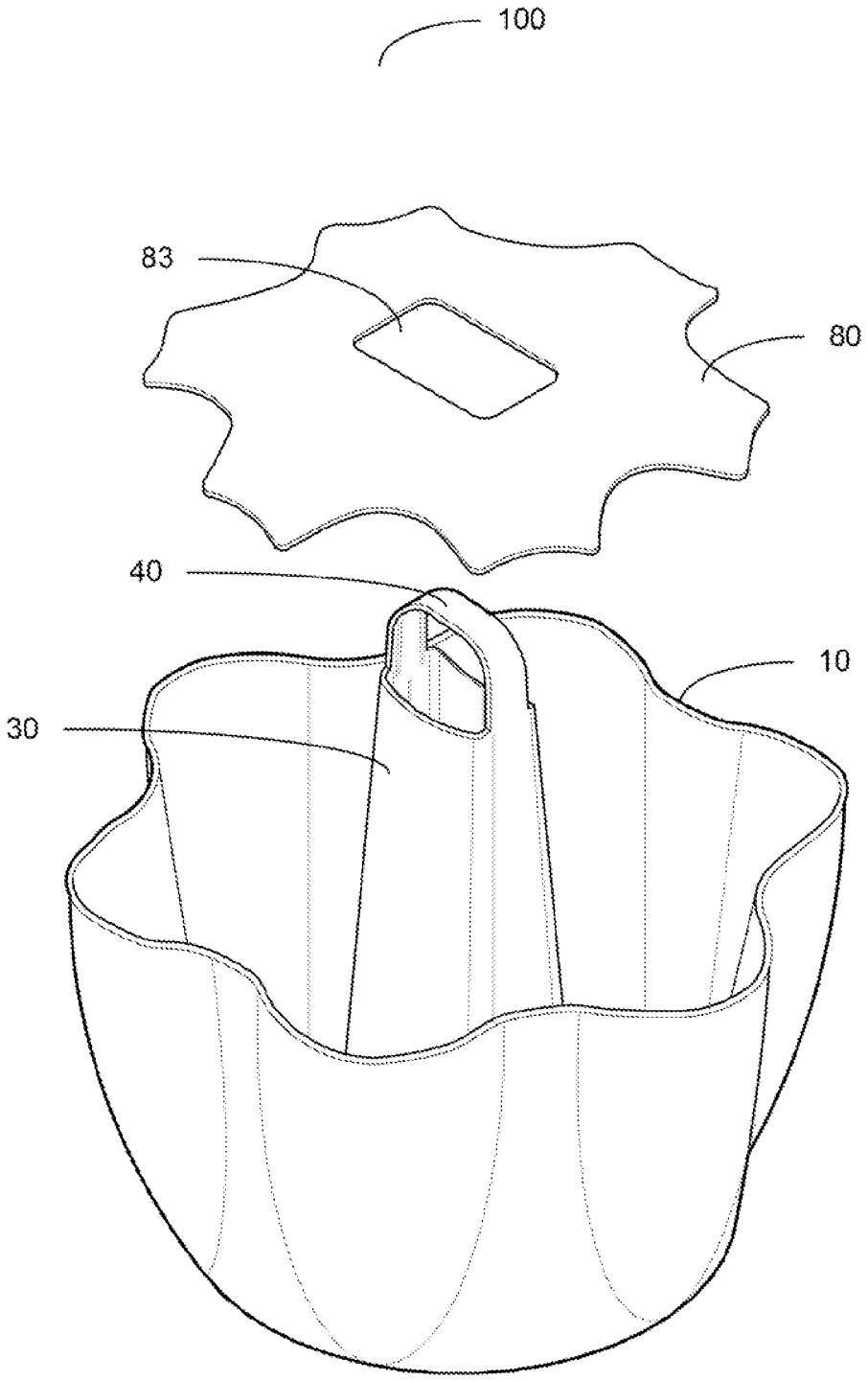
FIG. 4*c* illustrates an exploded view of one embodiment of a geometrically optimized beverage cooler with lid.

FIG. 4*c* illustrates an exploded view of one embodiment of geometrically optimized beverage cooler 100 with lid 40.

Figure 5:
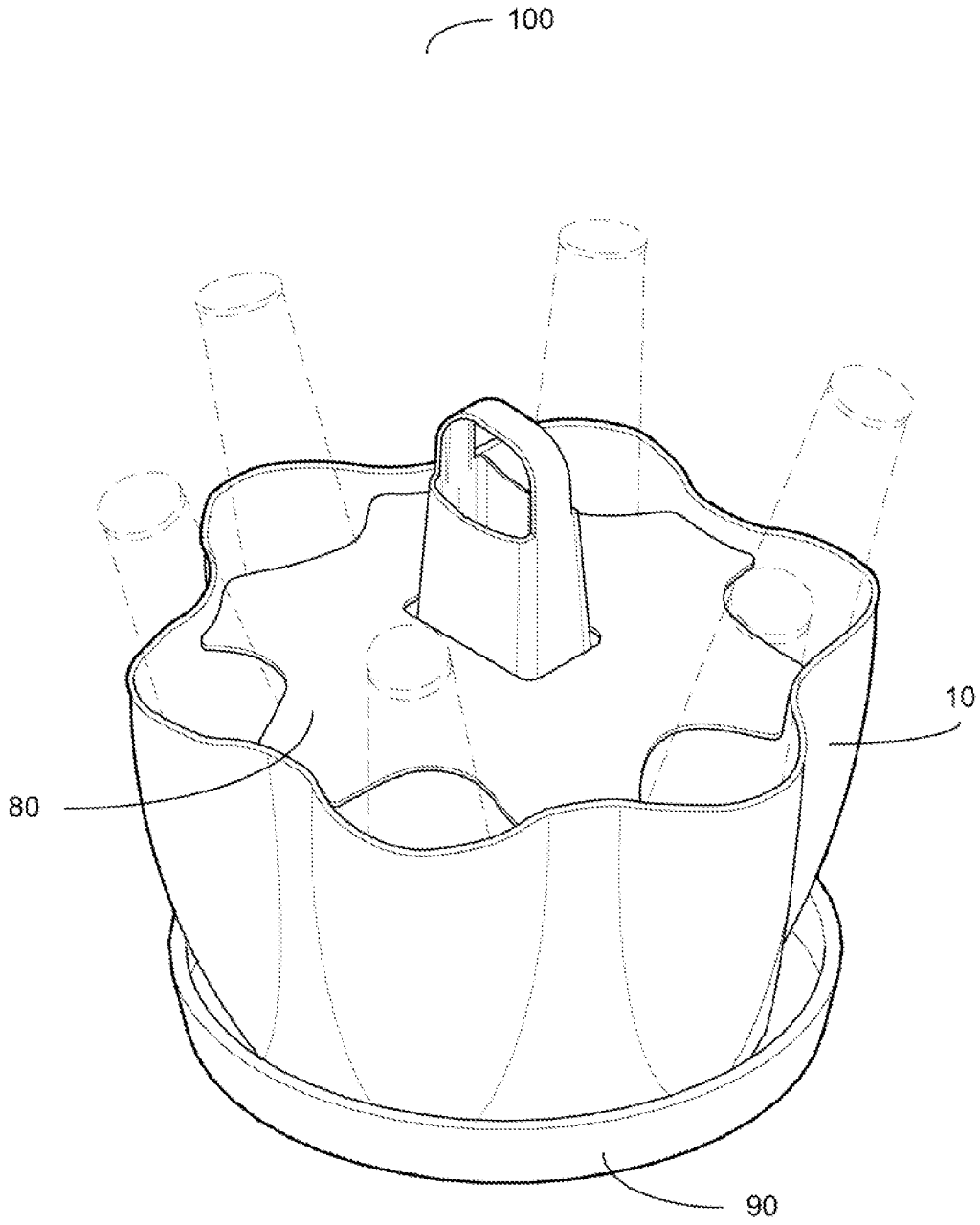
FIG. 5 illustrates a side perspective view of one embodiment of a geometrically optimized beverage cooler with optional drip pan.

FIG. 5 illustrates an embodiment of geometrically optimized beverage cooler 100 with lid 40 in place. In the embodiment shown, geometrically optimized cooler further includes optional drip pan 90.

In other embodiments, geometrically optimized beverage cooler 100 may further include additional structural features including, but not limited to a rotating base, or rubber feet. In various other embodiments, geometrically optimized beverage cooler 100 may include a drainage component including, but not limited to a drainage pan, drainage holes, or a drainage spout.

What is claimed is:

1. A geometrically optimized cooler comprised of:

a cooler body having a curved side surface and an angled bottom surface, said curved side surface having at least four support contours adapted to receive at least one cylindrical beverage container, wherein each of said at least four support contours includes at least one substantially convex contour and at least one substantially concave contour, wherein a first concave contour is located 180 degrees from a second concave contour along said curved side surface and a third concave contour is located 180 degrees from a fourth concave contour along said curved side surface, a convex bottom surface wherein the curvature of said convex bottom surface forms an angle of 25 to 90 degrees relative to a horizontal plane, wherein said convex bottom surface forms a support surface which causes said at least one cylindrical beverage container to rest at an angle within at least one substantially convex contour; and at least one center column, said center column having at least two tapered sides, wherein a height of said center column is greater than a height of said cooler body; wherein said cooler body and said at least one center column comprise an insulating layer.

2. The apparatus of claim 1, which is integrally constructed.

3. The apparatus of claim 1, wherein said angled bottom surface has a slope of 25 to 90 degrees so that said fluid-filled container is positioned at an angle 25 to 90 degrees.

4. The apparatus of claim 1, which further includes a handle integrally constructed with said center column.

5. The apparatus of claim 1, which further includes at least one handle integrally constructed to said curved side surface.

6. The apparatus of claim 1, which is constructed of high density polyethylene plastic.

7. The apparatus of claim 1, which is constructed from a material selected from a group consisting of plastic, glass, metal, alloys, composites, resins and combinations thereof.

8. The apparatus of claim 1, wherein said curved side surface further includes a structural supporting perimeter ridge.

9. The apparatus of claim 1, wherein said center column further includes at least one friction resistant structure.

10. The apparatus of claim 4, wherein said handle further includes a structurally reinforcing ridge.

11. The apparatus of claim 1, wherein said angled bottom surface further includes a flattened perimeter area including a minimum of three points of contact.

12. The apparatus of claim 1, wherein said center column includes one or more anti-compression ribs.

13. The apparatus of claim 1, wherein each of said at least one said support contour is substantially uniform.

14. The apparatus of claim 1, wherein each of said at least one said support contour is non-uniform.

15. The apparatus of claim 1, wherein the slope of said angled bottom surface is proportionate to the angle at which said fluid-filled container rests against said side surface.

16. The apparatus of claim 1, wherein said side surface is substantially transparent so that fluid filled containers are visible.

17. The apparatus of claim 1, which further includes a drainage component selected from a group consisting of a drainage pan, drainage hole, and a drainage spout.

18. The apparatus of claim 1, wherein said insulating layer is comprised of ice.

19. A geometrically optimized cooler stacking system comprised of:

at least two geometrically optimized cooler components, each of said at least two geometrically optimized cooler components is comprised of:

a cooler body having a curved side surface, and a convex bottom surface, said curved side surface having at least four support contours adapted to receive at least one cylindrical beverage container, wherein each of said at least four support contours includes at least one substantially convex contour and at least one substantially concave contour, wherein a first concave contour is located 180 degrees from a second concave contour along said curved side surface and a third concave contour is located 180 degrees from a fourth concave contour along said curved side surface, wherein the curvature of said convex bottom surface forms an angle of 25 to 90 degrees relative to a horizontal plane, wherein said convex bottom surface forms a support surface which causes said at least one cylindrical beverage container to rest at an angle within at least one substantially convex contour; and a tapered center column having at least one friction resistant structure, wherein a height of said tapered center column is greater than a height of said cooler body; wherein said cooler body and said tapered center column comprise an insulating layer.

20. The apparatus of claim 19, wherein said insulating layer is comprised of ice.

21. An apparatus for displaying and serving beverages comprised of:

a fluted outer housing having an inner surface, at least four support contours, and a convex bottom surface, wherein each of said at least four support contours includes at least one substantially convex contour and at least one substantially concave contour, wherein a first concave contour is located 180 degrees from a second concave contour along said curved side surface and a third concave contour is located 180 degrees from a fourth concave contour along said curved side surface, wherein the curvature of said convex bottom surface forms an angle of 25 to 90 degrees relative to a horizontal plane, wherein said convex bottom surface forms a support surface which causes said at least one cylindrical beverage container to rest at an angle within at least one substantially convex contour; wherein said fluted outer housing comprises an insulating layer covering the inner surface, said at least four support contours and the convex bottom surface.

22. The apparatus of claim 21, which includes at least one additional row containing a second set of fluid-filled containers which rest against said plurality of fluid-filled containers at a corresponding angle.

23. The apparatus of claim 21, which further includes a base component selected from a group consisting of a rotating base and rubber feet.

24. The apparatus of claim 21, wherein said insulating layer is comprised of ice.

* * * * *